United States Patent [19]

Avrea

[11] Patent Number: 5,044,430

[45] Date of Patent: Sep. 3, 1991

[54] METHOD AND APPARATUS FOR CONTINUOUSLY MAINTAINING A VOLUME OF COOLANT WITHIN A PRESSURIZED COOLING SYSTEM

[76] Inventor: Walter C. Avrea, 1071 E. Sandpiper Dr., Tempe, Ariz. 85283

[21] Appl. No.: 383,738

[22] Filed: Jul. 21, 1989

Related U.S. Application Data

[60] Division of Ser. No. 147,537, Jan. 25, 1988, abandoned, and a continuation-in-part of Ser. No. 632,526, Jul. 19, 1984, abandoned, which is a continuation of Ser. No. 372,915, Apr. 29, 1982, Pat. No. 4,461,342.

[51] Int. Cl.[5] ..... F01P 11/02

[52] U.S. Cl. ..... 165/104.32; 123/41.51; 123/41.54

[58] Field of Search ..... 165/104.32, 11.1; 123/41.15, 41.51, 41.54, 41.27

[56] References Cited

U.S. PATENT DOCUMENTS

| | | | |
|---|---|---|---|
| 2,054,525 | 9/1936 | Simmen | 123/41.15 |
| 3,254,707 | 6/1966 | Ferguson | 165/104.32 |
| 3,601,181 | 8/1971 | Avrea | 123/41.54 |
| 3,820,593 | 6/1974 | Pabst | 123/41.54 |
| 3,832,982 | 9/1974 | Guehr | 123/41.15 |
| 4,006,775 | 2/1977 | Avrea | 165/104.32 |
| 4,346,757 | 8/1982 | Cheong et al. | 165/104.32 |

*Primary Examiner*—Albert W. Davis, Jr.

*Attorney, Agent, or Firm*—Don J. Flickinger; Jordan M. Meschkow

[57] ABSTRACT

A sealed accumulator is positioned at a location remote from the conventional pressurized liquid cooling system of an internal combustion engine. An overflow conduit communicates between a high point in the system and the accumulator. A make-up conduit communicates between the accumulator and a low point in the system. A normally closed pressure valve, opening in response to system pressure exceeding a predetermined value, is in series with the overflow conduit. In series with the make-up conduit, is a normally closed one-way check valve. Minimum and maximum pressures within the accumulator are regulated respective relief valves. Optionally, a vent valve is installed at a high point for escape of air as coolant is introduced into the system.

24 Claims, 7 Drawing Sheets

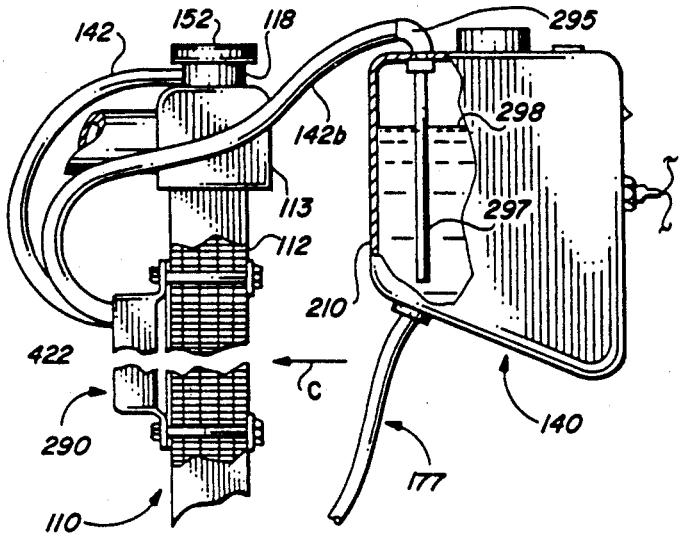
FIG-19
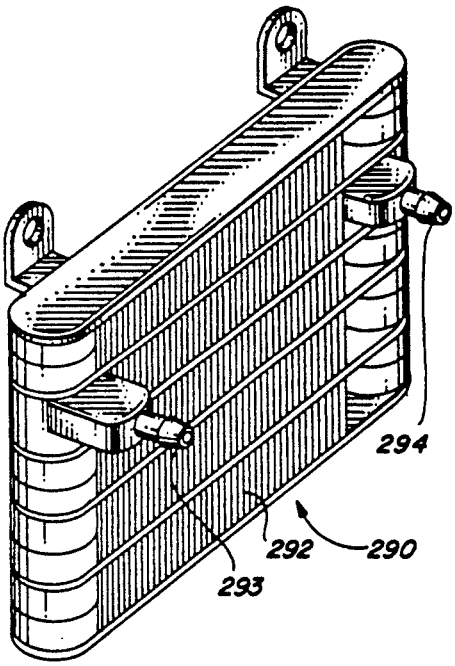
FIG-20
FIG-21
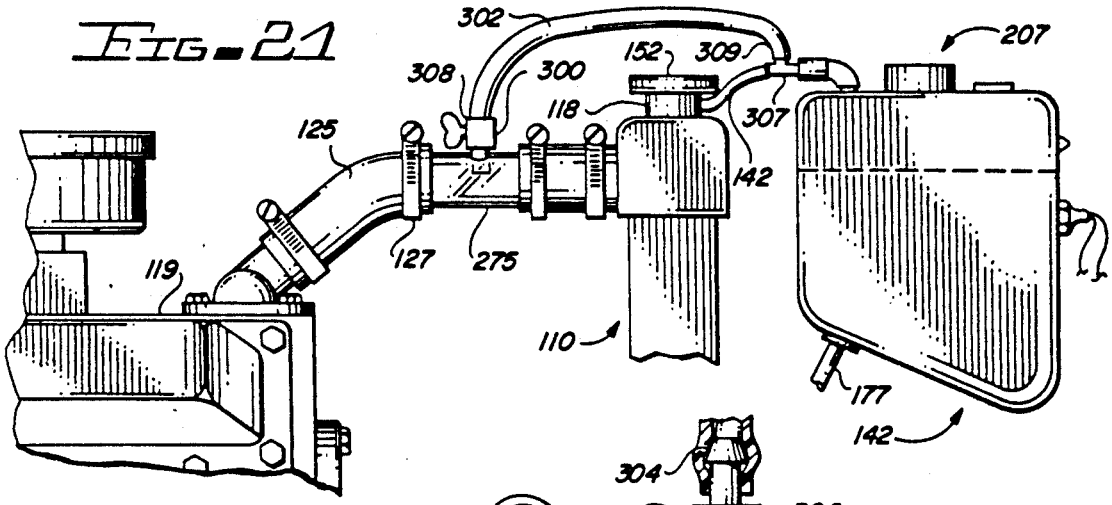
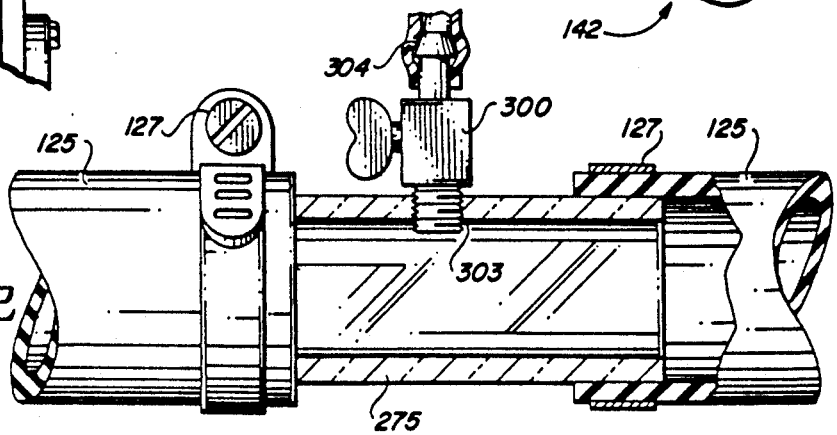
FIG-22

METHOD AND APPARATUS FOR CONTINUOUSLY MAINTAINING A VOLUME OF COOLANT WITHIN A PRESSURIZED COOLING SYSTEM

CROSS REFERENCE TO DELETED APPLICATION

This application is a continuation, of application Ser. No. 147,537, filed 25 Jan., 1988 now abandoned. which is a continuation-in-part of application, Ser. No. 632,526, filed 19 July 1984, now abandoned which in turn is a continuation of application, Ser. No. 372,915, filed 29 Apr. 1982, now issued as United States Letters Patent No. 4,461,342.

BACKGROUND OF THE INVENTION

1. Field of the Invention

This invention relates to cooling systems of the type especially adapted for use in connection with internal combustion engines.

More particularly, the present invention relates to pressurized cooling systems through which a liquid coolant in circulated.

In a further and more particular aspect, the present invention concerns improvements for continuously maintaining a volume of coolant within the system.

THE PRIOR ART

To maintain temperatures within safe limits, internal combustion engines are commonly provided with a pressurized liquid cooling system. Within the system, heat is absorbed from the engine and transferred for dissipation to the atmosphere. Liquid coolant, circulated within the closed circuit of the system, functions as the heat transfer medium.

Briefly, as will be readily appreciated by those skilled in the art, the system includes a water jacket encompassing the combustion chambers in which heat is generated as a result of the combustion of fuel. Terminating at respective ends with an inlet and an outlet, the jacket weaves a generally circuitous path within the engine. Typically, the outlet resides proximate the top of the engine while the inlet is located at a lower elevation.

A radiator, the heat dissipation component in the system, usually resides at a location spaced forwardly of the engine. Generally fabricated of relatively thin walled material, the radiator includes a core positioned between an inlet tank and an outlet tank. Functioning as a heat exchanger, the core serves to lower the temperature of the coolant flowing from the inlet tank to the outlet tank.

The inlet tank is provided with an inlet port. An outlet port is integral with the outlet tank. A supply conduit communicates between the outlet port of the outlet tank and the inlet port of the water jacket. Communicating between the outlet port of the water jacket and the inlet port of the inlet tank is a return conduit. The return conduit and the supply conduit are colloquially referred to as the upper radiator hose and the lower radiator hose, respectively.

Circulation of coolant within the system is effected by a pump having an intake port and a discharge port. Commonly referred as a water pump, the device is generally affixed to the engine with the discharge port in direct communication with the inlet port of the water jacket. Hence, the intake port functions as the inlet for the water jacket and receives the supply conduit extending from the outlet tank. In accordance with conventional technique, a fan for drawing a stream of air through the core of the radiator, is carried rearwardly of the radiator.

The conventional cooling system further includes a tubular member, dubbed the filler neck as a result of originally intended purpose. Extending from the inlet tank, the filler neck terminates with an open end encircled by an outwardly directed annular ledge and a depending circumferential skirt. Spaced from the open end is an inwardly directed annular ledge which functions as a valve seat. Intermediate the open end and the valve seat is an overflow vent, usually a radially projecting nipple.

A closure and valving apparatus, commonly referred to as a radiator cap, is detachably securable to the free end of the filler neck. The apparatus includes a cover which is extendable over the open end of the filler neck and carries engagement means which are detachably engagable with the engagement receiving means carried by the skirt. A valving assembly, usually including a pressure valve and a vent valve, are carried by the cover. The typical pressure valve includes a depending spring bearing against a disk-like member supporting an annular gasket. The disk-like member may also support the normally closed vent valve.

As a result of the configuration of the engagement means and the engagement receiving means, the cover is rotatable relative the filler neck between a removal position, an unlock position, and a lock position. Normally, the system functions with the cover in the lock position. As a result of the force of the spring, usually a coiled compression spring, the gasket is held in sealing engagement with the valve seat. In the unlock position, the gasket is spaced from the valve seat and fluid communication is established between the inlet tank and the overflow vent. The closure and valving apparatus is separable from the filler neck in the removal position.

It is common knowledge that for optimum operation the temperature of an internal combustion engine must be elevated above ambient. It is equally well-known that contemporary internal combustion engines are capable of operation at temperatures substantially above the normal boiling point of water. With judicious selection of coolant and proper choice of pressure valve, a pressurized liquid cooling system is compatible with such conditions of operation. For example, a coolant comprising fifty percent water and fifty percent ethylene glycol used in combination with a pressure valve having a compression spring exerting fifteen pounds of pressure will provide a system in which the boiling point is raised to approximately 271° Fahrenheit. Even at normal operating temperatures, however, the coolant expands in response to absorption of heat. In a properly functioning system, thermal expansion is usually in the range of three to five percent. Considering a system having a nominal capacity of 16 quarts, five percent expansion increases the volume of coolant by 25.6 ounces or 0.8 quarts.

Assuming the system is filled to capacity, the expanding coolant will counteract the spring and unseat the valve allowing the excess coolant to escape through the overflow vent. Upon cooling, generally after cessation of operation of the engine, the coolant contracts creating a potential vacuum within the system. In response thereto, the vent valve opens allowing make-up fluid to enter the cooling system.

Originally, the coolant overflow containing expensive anti-freeze was lost, having been discharged to fall upon the ground. Air became the naturally occurring make-up fluid. It was periodically necessary, therefore, that motorists remove the radiator cap and add make-up liquid, usually water.

During the relatively recent past, a solution to the foregoing problem was devised. The remedying apparatus included a container or overflow reservoir positioned within the engine compartment remote from the radiator. An overflow conduit communicated between the bottom of the container and the overflow vent of the filler neck. The coolant overflow was discharged into the reservoir where it was held and subsequently returned to the cooling system during cool-down. A vent, open to the atmosphere, prevented bursting or collapsing of the container during respective cycles of the cooling system. The remedy, which achieved substantial commercial success, became know as "Coolant Recovery System". With the advent of the coolant recovery system, came an awareness of the effect of air within the cooling system. Although not universally understood nor appreciated by practitioners in the art, air within the cooling system is extremely deleterious. The presence of air, a heat transfer medium vastly inferior to liquids such as water and anti-freeze, materially reduces cooling system efficiency. Among the system deteriorating effects, air is responsible for cavitation of the water pump, corrosion of the water jacket, and oxidation of radiator hoses. As a statistical example, it can be shown that the presence of five percent air will reduce maximum system pressure by approximately fifty percent.

The coolant recovery system addressed the problem of air within the system. Use was made of the phenomenon that any free air within the system will rise to the top of the inlet tank. Coolant, rising as a result of thermal expansion, will displace the air which will be forced out through the vent and the conduit into the overflow reservoir. In reality, most air will be purged in a foamy or vaporous combination with coolant. Depending upon the heat buildup, a quantity of coolant will follow the air and the vaporous combination into the reservoir.

As the overflowed vapor or foam condenses within the reservoir, the entrained air effervesces upwardly and escapes through the vent into the atmosphere. The deaerated coolant settles to the bottom of the reservoir. As the system cools, only the deaerated coolant will be siphoned back through the vent valve.

To complement the function of the coolant recovery system, companion developments were made regarding the radiator cap. The imeliorated cap design positively prevented communication between the cooling system, except for the atmospheric vent in the overflow reservoir, and the atmosphere. Motorists were instructed to maintain a reserve supply of coolant within the overflow reservoir. To retard evaporation and entrance of air into the system, the radiator cap was removed, if ever, only when the system was cool. Periodic replenishment was accommodated through an opening in the reservoir.

Despite unparalleled advancement to the art and international acceptance, the coolant recovery system has not been an optimum solution. Being vented to the atmosphere, coolant evaporated from the overflow reservoir. Another quantity of coolant was lost along with the escaping vaporous combination of air and coolant. Further, inattentive motorists frequently neglected to maintain a necessary minimum level of coolant within the reservoir.

More importantly, however, the coolant recovery system is dependent upon cyclic heat and cooling of the engine. Air is expelled from the cooling system only during heating and coolant is returned only during cooling. Inspection and attention of the fluid within the system was limited to the vehicle being at rest with a cool engine. Replenishment of coolant, as may be necessary to accommodate a leak within the cooling system, was not possible.

The prior art has provided a purported solution to the foregoing problems. One solution was the provision of a combination radiator/automatic positive anti-aeration system in which the components were assembled to function cooperatively as integral units in which external plumbing is either entirely eliminated or reduced to a minimum. For a modification of preexisting vehicles, however, the modifications required that the radiator be removed from the vehicle, physically disassembled, reduced in width, reassembled, and reinstalled in the vehicle. The substantial expense of such a modification and the adverse effect on cooling system performance made the system less than an optimum solution.

The prior art has also made attempts to warn the motorist of an imminent overtemperature condition as a result of low coolant level. Proposed was a pencil-like probe which was inserted into the radiator header tank through an especially created aperture. An hermetic seal was established between the aperture in the radiator header tank and the coolant sensor probe by a complex seal assembly including a threaded fitting, washers and various sealing devices. The device, however, failed to alert a vehicle driver until after the volume of circulating coolant had decreased to a critical level. Further, the probe was eventually rendered useless as the result of an accumulated coating of deposits of material normally held in suspension within the coolant.

It would be highly advantageous, therefore, to remedy the foregoing and other deficiencies inherent in the prior art.

Accordingly, it is an object of the present invention to provide improvements in pressurized liquid cooling systems of the type normally used in connection with internal combustion engines.

Another object of the invention is the provision of increasing the effective capacity of a liquid cooling system by making available to the system, during engine operation, a reserve supply of coolant held in an accumulator.

Another object of the invention is to provide means for deaerating and receiving overflow from a pressurized liquid cooling system and making the overflow available for return to the system while the engine is in operation.

Still another object of the present invention is the provision of improvements whereby the condition and character of the coolant may be examined when the engine is hot.

Yet another object of the invention is to provide an automatically refillable engine coolant system which provides a sensible warning of a coolant loss condition.

Yet still another object of this invention is the provision of means for cooling and condensing overflow coolant before being received within the accumulator.

And a further object of the invention is to provide means to retard evaporation of liquid from the reserve supply.

And a further object of the instant invention is the provision of improvements for more expeditiously purging air from the pressurized liquid cooling system of an internal combustion engine.

Yet a further object of the invention is to provide improvements of the foregoing character which may comprise a kit for retrofit to a preexisting conventional cooling system.

And still a further object of the invention is the provision of relatively inexpensive improvements which are readily and conveniently installed with common tools and without modification to the existing hardware.

SUMMARY OF THE INVENTION

Briefly, to achieve the desired objects of the instant invention, in accordance with a preferred embodiment thereof, there is provided a normally sealed accumulator and an overflow conduit for flow of fluid between a high point in the cooling system and the accumulator. Normally closed pressure valve means are placed in series with the overflow conduit for permitting fluid flow from the system into the accumulator when the pressure within the system exceeds a predetermined maximum value.

A make-up conduit communicates between a low point in the accumulator and a selected location within the system, preferably upstream of the water pump. A check valve in series with the make-up conduit permits flow of fluid from the accumulator into the system when pressure in a direction toward the system is greater than pressure in a direction toward the accumulator.

In a further embodiment, the accumulator includes a normally closed first relief valve opening in response to pressure within the accumulator descending a predetermined minimum value and a second relief valve opening in response to pressure within the accumulator exceeding a predetermined maximum value. The accumulator further includes normally sealed filler means for introduction of coolant into the accumulator. More specifically, the filler means includes an opening in the accumulator and a sealingly engagable closure member.

In a system wherein the radiator includes a filler neck extending from the inlet tank, the normally closed pressure valve means may include an attachment member detachably engagable with the filler neck, a valve member sealingly engagable with the valve seat of the filler neck, and biasing means depending from the attachment member and normally urging the valve member into sealing engagement with the valve seat. The pressure valve means may further include an atmospheric seal engagable with the filler neck to prohibit flow of fluid from the open end of the filler neck during flow of fluid from the radiator to the overflow vent. The overflow vent may also function as the high point in the system for receiving an end of the overflow conduit.

The normally closed pressure valve means, in accordance with an alternately preferred embodiment of the invention, is carried by an insert which is positionable in series with the preexisting return conduit. Preferably, the insert is in an the form of a tubular member having ends which are sealingly engaged within the respective ends created when the return conduit is severed. Placed at a high point in the system, the insert provides means for attachment of the end of the overflow conduit. Window means for visual inspection of the fluid in the system may also be carried by the insert. When used in combination with systems having a filler neck extending from the radiator, means are provided for sealing the filler neck.

Further provided by the instant invention are vent means for selectively venting the system to allow the escape of air as the system is initially filled with coolant through the accumulator and the make-up conduit. The vent means may assume the form of a manually operable valve placed at a high point in the system, such as the previously noted insert. Alternately, the system is vented by rotation of the attachment member relative the filler neck to the unlock position. A discharge conduit communicates between the discharge port of the vent means and the accumulator.

Heat exchanger means, in series with the overflow conduit, cools the fluid before being received within the accumulator. In accordance with a specific embodiment, the heat exchanger means includes means defining a circuitous path for the flow of fluid and means for increasing the ambiently exposed area of the circuitous path. The heat exchanger may be placed proximate a terminal portion of the overflow conduit within the accumulator. Alternately, the heat exchanger may reside within the path of the stream of air drawn through the radiator by the cooling fan associated with the cooling system.

The instant invention further contemplates signaling means for providing a sensible indication that the coolant within the accumulator has descended a predetermined level. The signaling means includes a sensor carried by the accumulator for emitting a signal when the predetermined level has been reached and an indicator for displaying a sensible indication in response to receiving the signal from the sensor means. More specifically, the sensor may be in the form of a float switch and the indicator may be in the form of a warning light.

BRIEF DESCRIPTION OF THE DRAWINGS

The foregoing, and further and more specific objects and advantages of the instant invention, will become readily apparent to those skilled in the art from the following detailed description of preferred embodiments thereof taken in conjunction with the drawings in which:

FIG. 19 is a view generally corresponding to the upper right-hand portion of the illustration of FIG. 9 and showing an alternate embodiment thereof;

FIG. 20 is an enlarged perspective view of the heat exchanger seen in FIG. 19;

FIG. 21 is an illustration generally corresponding to the illustration of FIG. 19 and showing yet a further embodiment of the instant invention including manually operable vent means; and FIG. 22 is an enlarged fragmentary view, partly in section, further illustrating the vent means seen in FIG. 21.

DETAILED DESCRIPTION OF THE PREFERRED EMBODIMENTS

Figure 1:
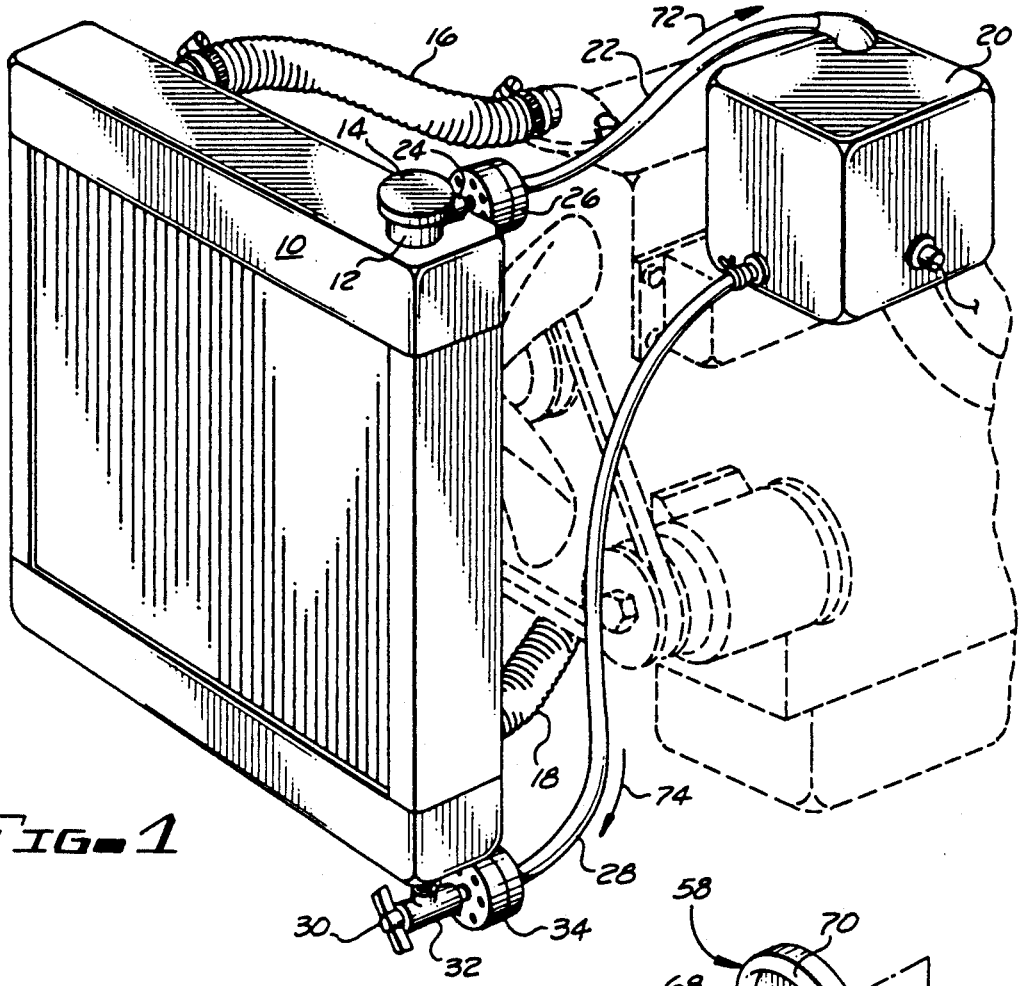
FIG. 1 illustrates an embodiment of the invention which can be added to a conventional engine cooling system.

In order to illustrate the advantages of the invention and the contributions to the art, preferred embodiments of the invention will now be described in detail with reference to the drawings in which like reference characters represent corresponding elements throughout the several views.

Figure 2:
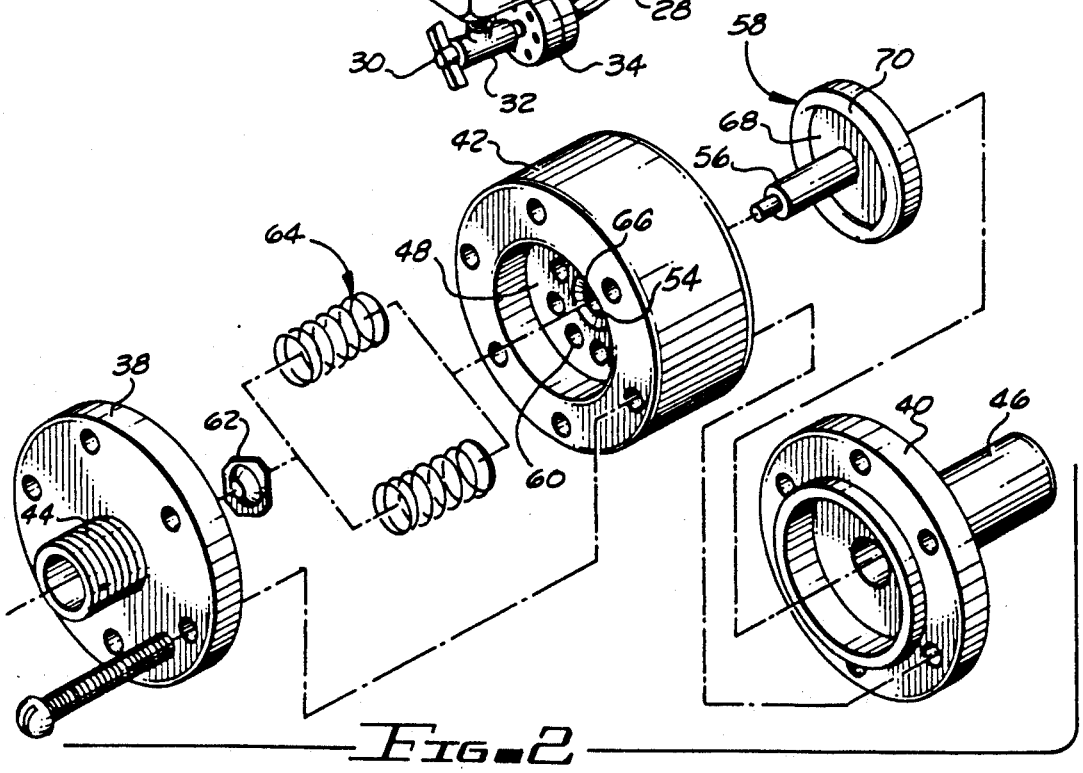
FIG. 2 represents an exploded perspective view of the component parts of one embodiment of a one-way check valve utilized as an element of the present invention.
Figure 3:
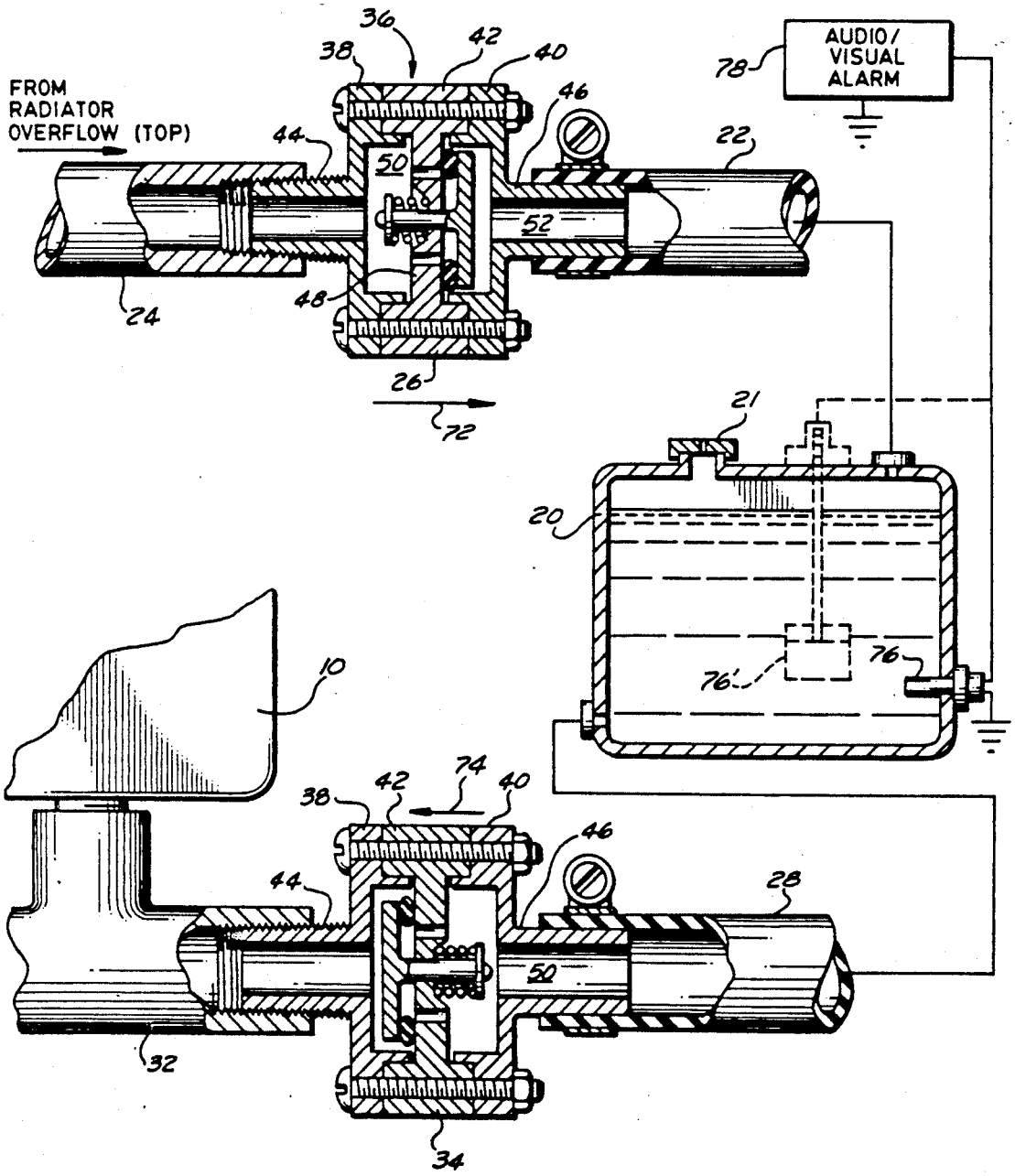
FIG. 3 represents a partially cutaway sectional view of the first and second one-way check valve and the coolant reservoir of the present invention, particularly illustrating the internal structure of the system check valves and low coolant warning system.

Referring first to FIGS. 1, 2, and 3, an engine cooling system includes a radiator 10 having a filler neck 12 and a pressure cap 14 which forms a fluid tight seal with filler neck 12. A first fluid flow conduit 16 permits engine coolant to be transferred from the engine into the radiator while a second fluid flow conduit 18 permits engine coolant to be transferred from the radiator into the water jacket. The engine cooling system further includes a coolant reservoir 20 which is physically spaced apart from radiator 10 and elevated above the lower surface of radiator 10. Reservoir 20 includes a filler cap 21 having a vent hole for maintaining an ambient pressure level within reservoir 20. A coolant transfer conduit 22 is coupled at one end to a coolant overflow fitting 24 and at the opposite end to coolant reservoir 20.

A high pressure one-way check valve 26 is coupled in series with coolant transfer conduit 22. In FIG. 1, check valve 26 is shown having one end coupled directly to radiator filler neck 12, while a second end is coupled to an end of coolant transfer conduit 22. Check valve 26 includes a biasing spring that determines the pressure level which permits coolant to be transferred from radiator 10 through coolant transfer conduit 22 into coolant reservoir 20. The spring biasing force is typically set such that check valve 26 opens when the pressure level within radiator 10 exceeds a predetermined value, such as 15 P.S.I.

A coolant refill conduit 28 is coupled at one end to a low point in the engine cooling system, such as a low point on radiator 10. FIG. 1 depicts a radiator having a port in the lowermost part thereof which includes a drain petcock 30. In a radiator of this type, petcock 30 is removed from the radiator and a "T"-fitting 32 is coupled as shown to that port. Petcock 30 is then reconnected to one of the ports of "T" 32 while a low pressure one-way check valve 34 is coupled to the remaining port of "T" 32. The end of coolant refill conduit 28 is coupled to the inlet port of check valve 34.

Because of the comparatively high pressure levels existing at the radiator sides of check valves 26 and 34, FIG. 3 illustrates that tapered plumbers threads are utilized to provide a hermetic seal between check valves 26 and 34 and the fittings coupled to radiator 10. Any other equivalent sealed coupling means such as rubber hoses and hose clamps may also be used to provide the required hermetic coupling. It is important that the other fluid couplings between check valves 26 and 34 and reservoir 20 be fluid tight to prevent leakage, but since the pressure levels involved are significantly lower, normal hose clamp coupling systems can be used with little difficulty.

FIGS. 2 and 3 illustrate that check valves 26 and 34 are fabricated from identical and interchangeable components. Only the spring force provided by the biasing spring within the two check valves differs. With this single exception, the two check valves are interchangeable as long as each valve is coupled in the cooling system to provide fluid flow in the proper direction.

Each check valve includes a valve body 36 which defines the external housing of the valve and which includes a first end section 38, a second end section 40 and a center section 42. First end section 38 includes an inlet port 44 while second end section 40 includes an outlet port 46. Center section 42 includes dividing means in the form of a valve diaphragm 48 which divides the interior valve chamber of valve body 36 into an inlet chamber designated by reference number 50 and an outlet chamber designated by reference number 52. Valve diaphragm 48 further includes a centrally located aperture 54 for receiving the valve stem 56 of a valve element 58. A plurality of apertures, such as the aperture designated by reference number 60, are formed in valve diaphragm 48 at equal radial intervals.

Valve stem 56 of valve element 58 extends from outlet chamber 52 through aperture 54 into inlet chamber 50. Removable securing means in the form of a Tinnerman nut 62 is coupled to the reduced diameter end section of valve stem 56 and maintains a biasing means in the form of a spring 64 in place between nut 62 and bevelled recess 66 which surrounds aperture 54 in valve diaphragm 48. Bevelled recess 66 maintains the end of spring 64 centered with respect to aperture 54.

Valve element 58 further includes a valve surface 68 which is coupled to the end of valve stem 56 Sealing means such as an "O"-ring 70, a flat rubber disc or other means for forming a seal between the inner surface of valve surface 68 and valve diaphragm 48 is coupled to valve surface 68. In the normally closed position of the one-way check valve, biasing spring 64 maintains valve element 58 sealed against valve diaphragm 48 so that fluid cannot flow from inlet chamber 50 into outlet chamber 52 until the pressure of the liquid within inlet chamber 50 exceeds a predetermined value fixed by the biasing force provided by spring 64. In one-way check valve 26, spring 64 typically provides a predetermined biasing force sufficient to open one check valve 36 at a predetermined pressure, such as 15 P.S.I. Spring 64 typically provides a predetermined biasing force sufficient to open one-way check valve 34 at a predetermined pressure, such as ½ P.S.I.

As a result of the minimal biasing force provided by spring 64 in one-way check valve 34, valve 34 if oriented in a vertical position will open and permit fluid flow if only a quantity of water sufficient to fill inlet chamber 50 and the cylindrical passageway within inlet port 44 is added.

FIGS. 2 and 3 indicate that a plurality of securing means such as nuts and bolts extend through the outer periphery of valve body 36 to couple together and form a fluid tight seal between first end section 38, second end section 40, and center section 42. Many other different types of securing means for accomplishing an equivalent function would be readily apparent to one of ordinary skill in the art. The arrows designated by reference numbers 72 and 74 indicate the direction of fluid flow through valves 26 and 34 respectively.

Coolant transfer conduit 22 may be coupled to coolant reservoir 20 at virtually any location, but it is preferable to couple conduit 22 to a comparatively high point in reservoir 20 as is depicted in FIG. 3. Coolant refill conduit 28 should be coupled to coolant reservoir 20 at a comparatively low point to permit the maximum amount of coolant within reservoir 20 to be available for transfer into radiator 10.

Coolant reservoir 20 may also include a coolant level sensing device 76 which extends into the interior of reservoir 20. When a sufficient amount of coolant has been transferred out of reservoir 20 such that the end of level sensing device 76 is exposed to the air, the voltage output across the electrical terminal of this device is altered. This voltage change actuates an audio/visual alarm 78 to indicate to the vehicle operator that the condition of the engine cooling system should be investigated immediately. The coolant level sensing device therefore indicates a potentially dangerous engine operating condition before a conventional engine overtemperature warning light and may prevent substantial engine damage as a result of such early warning.

In the preferred embodiment of the invention, an oil level probe model OL-1 manufactured by Sterling Technologies Incorporated of Southfield, Michigan is utilized as fluid level sensing device 76. Specifications from Sterling Technologies include installation instructions for their level sensing probe.

The operation of the present invention will now be described in connection with FIGS. 1 and 3. To initially fill the engine cooling system with coolant, filler cap 21 is removed and engine coolant is added through the filler neck of reservoir 20. Pressure cap 14 is removed from radiator 10 to permit air to be discharged from the engine cooling system as replacement fluid is added to the cooling system. Coolant being poured into the interior of coolant reservoir 20 flows through coolant refill conduit 28 into inlet chamber 50 of low pressure check valve 34. The head pressure created by the vertical spacing differential between the point at which conduit 28 is coupled to reservoir 20 and the elevation of check valve 34 exerts a force on valve surface 68 sufficient to overcome the opposing biasing force exerted by spring 64. Valve element 58 is therefore displaced into outlet chamber 52 and permits fluid to flow from the interior of coolant reservoir 20 through fitting 32 into the bottom of radiator 10. The coolant fills the lower section of radiator 10 and simultaneously flows through conduit 18 into the water jacket of the engine. Air displaced by the incoming coolant is vented through the open filler neck 12 of radiator 10.

Filling the engine cooling system from the bottom in the manner disclosed above virtually completely purges air from the cooling system. If coolant reservoir 20 is placed at a sufficient height within the engine compartment with respect to filler neck 12 of radiator 10, the engine cooling system can be virtually completely filled by merely adding coolant to the interior of reservoir 20. When the engine cooling system has been filled with coolant, pressure cap 14 is replaced on filler neck 12 and filler cap 21 is replaced on reservoir 20.

As the engine is operated, the coolant within the cooling system is heated and expands. As the internal cooling system operating pressure exceeds 15 P.S.I., any air in the system is discharged through check valve 26 and coolant transfer conduit 22 into the vented interior of coolant reservoir 20. During successive engine operating cycles, all air within the cooling system will be completely purged and only liquid coolant will be discharged through check valve 26.

When the engine is shut down and the coolant temperature is reduced, a slight negative pressure is created within the cooling system, causing check valve 34 to open and transfer coolant from reservoir 20 into radiator 10.

A highly unique feature of the present invention is that the present cooling system configuration is capable of maintaining the cooling system completely full of coolant even though the cooling system may be leaking coolant from a defective fitting, hose, or other cooling system component. A leak of this type generally presents itself only when the engine is operating, the cooling system temperature is elevated and the system is in at least a partially pressurized state to create a pressure differential across the cooling system leakage path. Such a leak produces a significant reduction in the system pressurization and permits the head pressure created by the elevation differential between coolant reservoir 20 and check valve 34 to exert a sufficient pressure across check valve 34 to permit a flow of coolant from reservoir 20 into the cooling system. In addition, the normal circulation of coolant from the lower portion of radiator 10 through conduit 18 to the engine driven water pump creates a negative pressure on the order of 4 P.S.I. in the vicinity of the place where conduit 18 is coupled to radiator 10. For this reason, it is advantageous to position check valve 34 in the proximity to that negative pressure area to increase the pressure differential across check valve 34. Thus a flow of replacement coolant from reservoir 20 into radiator 10 is created both by the positive head pressure created by the vertical elevation difference between reservoir 20 and check valve 34 and also by the negative pressure created by coolant circulation from radiator 10 through conduit 18.

A cooling system leak causes the level of replacement coolant within reservoir 20 to fall and continuously indicates to one observing the coolant level in reservoir 20 the amount of coolant which bas been discharged from the cooling system. Continued loss of coolant from reservoir 20 will ultimately expose level sensing device 76 to the atmosphere and will actuate audio/-visual alarm 78 in the passenger compartment of the vehicle. The driver will be immediately alerted to shut down the engine and investigate the source of cooling system leakage.

As a result of the system operation as discussed above, the coolant stored within reservoir 20 is effectively available to the engine cooling system whether the engine is operating or shut down. The level of coolant within reservoir 20 accurately indicates the total quantity of coolant available to the engine and enables a vehicle operator or vehicular maintenance personnel to determine whether additional coolant is required by merely observing the quantity of coolant remaining within reservoir 20. It is not necessary to remove pressure cap 14 and visually inspect the coolant level within radiator 10.

The only moving parts utilized within this automatically refillable cooling system are contained within externally positioned, readily accessible and removable oneway check valves 26 and 34. Each check valve is easily disassembled by removing the nuts and bolts which couple the component parts of the valve together. Once the external housing has been disassembled, Tinnerman nut 62 can be removed permitting either repair or replacement of all valve elements as required. Since both check valves are fabricated from identical components except for spring 64, an extremely limited quantity of replacement parts can be stocked by aftermarket parts suppliers to permit inexpensive repairs to the system check valves. In the preferred embodiment of the present invention, every element of the check valve except for the "O"-ring 70 or equivalent sealing means, spring 64 and Tinnerman nut 62 are fabricated from a high temperature plastic such as Delrinoplastic. These plastic components are readily and inexpensively manufactured by well know techniques and provide a highly durable valve which is readily made fluid tight.

The embodiment of the invention illustrated in FIG. 1 can be readily retrofitted to cooling systems of vehicles which include a remotely mounted coolant reservoir. If the radiator includes a petcock, the addition of "T"-fitting 32, check valve 34 and coolant refill hose 28 is sufficient to convert a standard prior art system to an automatically refillable system. Virtually all liquid engine cooling systems utilize a pressure cap 14 having at least a single one-way check valve which is actuated at about 15 P.S.I. to discharge coolant through coolant overflow fitting 24 and coolant transfer conduit 22 either onto the ground or into a coolant reservoir. Most automotive vehicles manufactured during the past 5-6 years utilize a pressure cap including first and second one-way check valves in combination with coolant transfer conduit 22 and coolant reservoir 20. For both installations, it is not essential that pressure cap 14 be replaced and that a separate one-way check valve 26 be added as depicted in FIG. 1. However, due to the significant advantages achieved by the utilization of check valve 26 of the specific configuration disclosed, a significantly more reliable automatically refillable cooling system can be achieved and the need to periodically replace pressure cap 14 will therefore be eliminated. If it is also desired to add a level sensor/alarm unit to an existing vehicular cooling system, such structure can readily be added with little difficulty.

The present invention may also be added to vehicular engine cooling systems during manufacture. In this case, a manufacturer may wish to redesign the radiator housing to eliminate filler neck 12 and coolant overflow fitting 24. The radiator housing may be designed to permit coupling of check valves 26 and 34 directly to threaded Fittings attached to the radiator housing itself. In this configuration, a separate pressure release valve is fitted to the engine cooling system at a comparatively high point, such as the upper portion of radiator 10, so that such a valve may be actuated to permit air to be purged from the engine cooling system as coolant is initially added to the engine through coolant reservoir 20.

Figure 4:
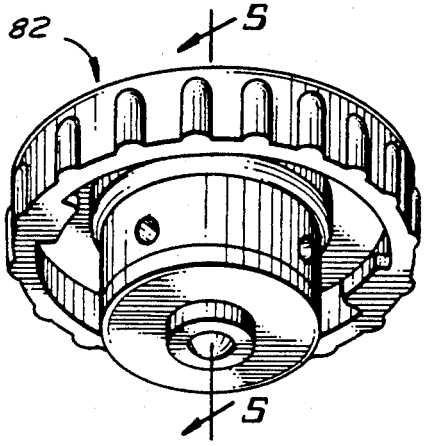
FIG. 4 is a perspective view of a radiator pressure cap including a one-way check valve for use in combination with the present invention.
Figure 5:
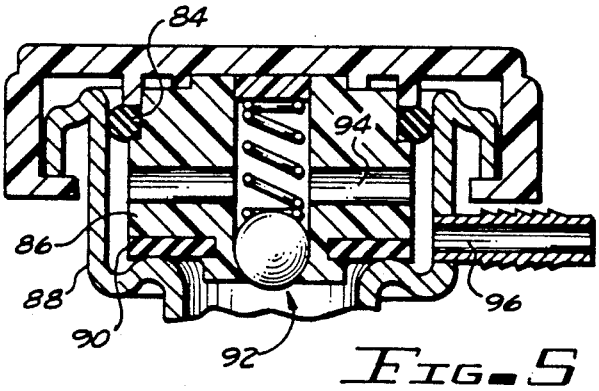
FIG. 5 is a sectional view of the pressure cap depicted in FIG. 4, taken along section line 5—5.

Referring now to FIGS. 4 and 5, a high pressure one-way check valve 82 is disclosed which may be utilized in connection with radiator designs of the type depicted in FIG. 1, rather than utilizing a separate outboard check valve 26. U.S. Pat. No. 4,079,855 (Avrea) discloses a monolithic radiator cap which is fabricated from plastic and which includes "O"-ring sealing means. The fabrication of that cap and cap 82 are similar. That patent is therefore incorporated herein by reference.

Check valve 82 includes sealing means in the form of an "O"-ring 84 which provides an hermetic seal between the outer cylindrical section 86 of valve 82 and the inner cylindrical section of filler neck 88. The lower section of valve cylindrical section 86 is tightly sealed to filler neck 88 by gasket 90. A spring biased ball check valve assembly 92 permits either air or coolant to be discharged from the radiator through passageways 94 and out of coolant overflow fitting 96 when a predetermined pressure, such as 15 P.S.I. is exceeded.

Figure 6:
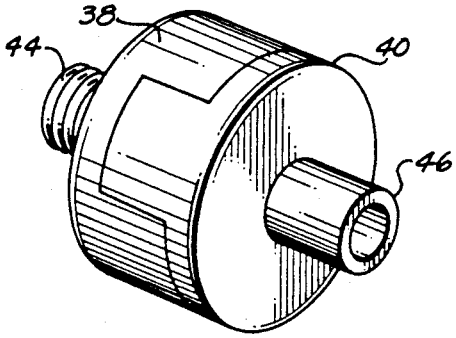
FIG. 6 is a perspective view of a second embodiment of a one-way check valve of the type illustrated in FIG. 2.
Figure 7:
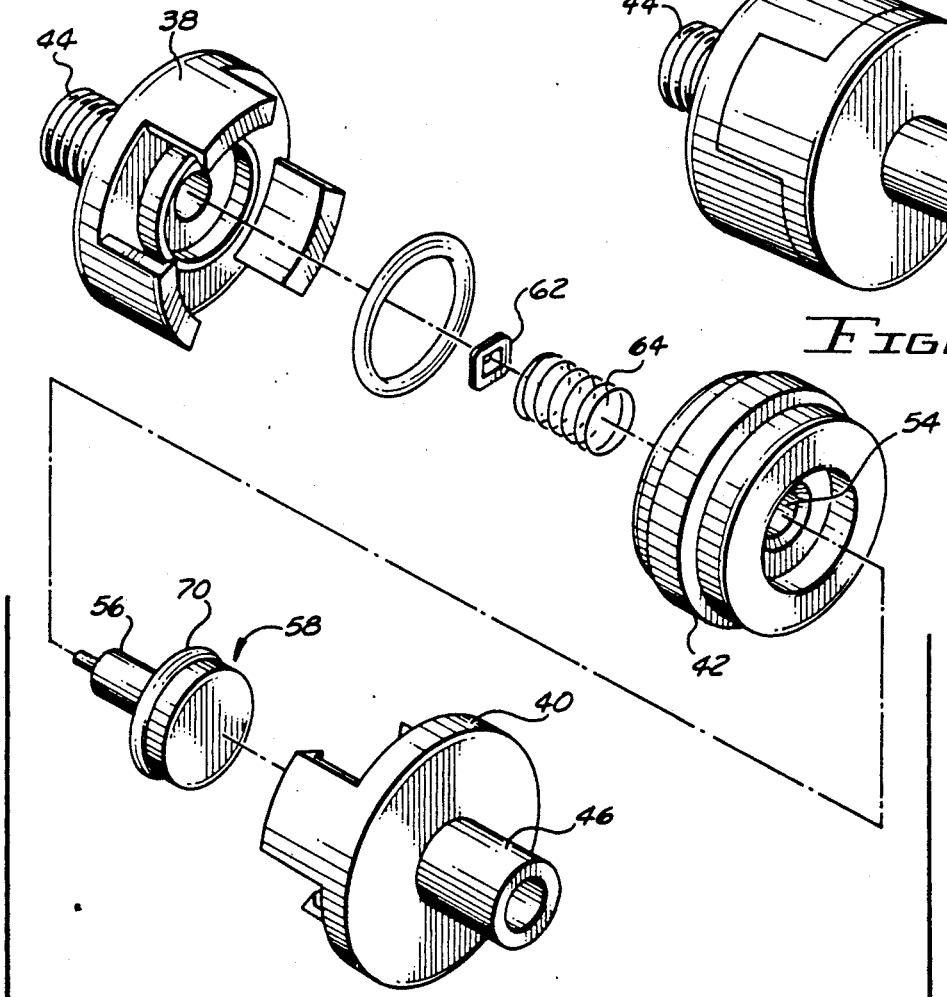
FIG. 7 is an exploded perspective view of the one-way check valve illustrated in FIG. 6.

Referring now to FIGS. 6 and 7, a second embodiment of check valves 26 and 34 is illustrated. In this embodiment, end sections 38 and 40 include three spaced apart clips which can be displaced over the centrally located, raised exterior section of valve center section 42. This modified valve embodiment eliminates the requirement for bolt and nut securing means as utilized in the previously discussed oneway check valve embodiment. The FIG. 6 embodiment can be manufactured at less cost and can be assembled and disassembled more readily than the previously discussed embodiment.

Figure 8A:
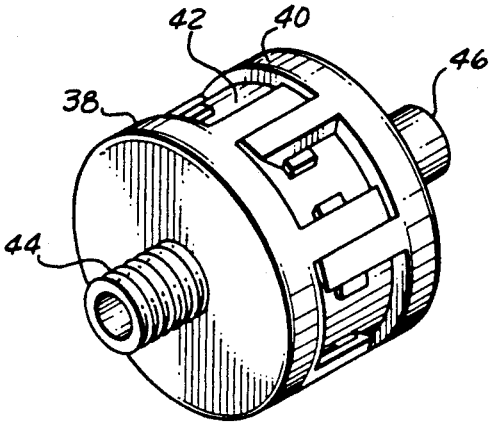
FIGS. 8A and 8B depict a third embodiment of a one-way check valve of the type illustrated in FIG. 2.
Figure 8B:
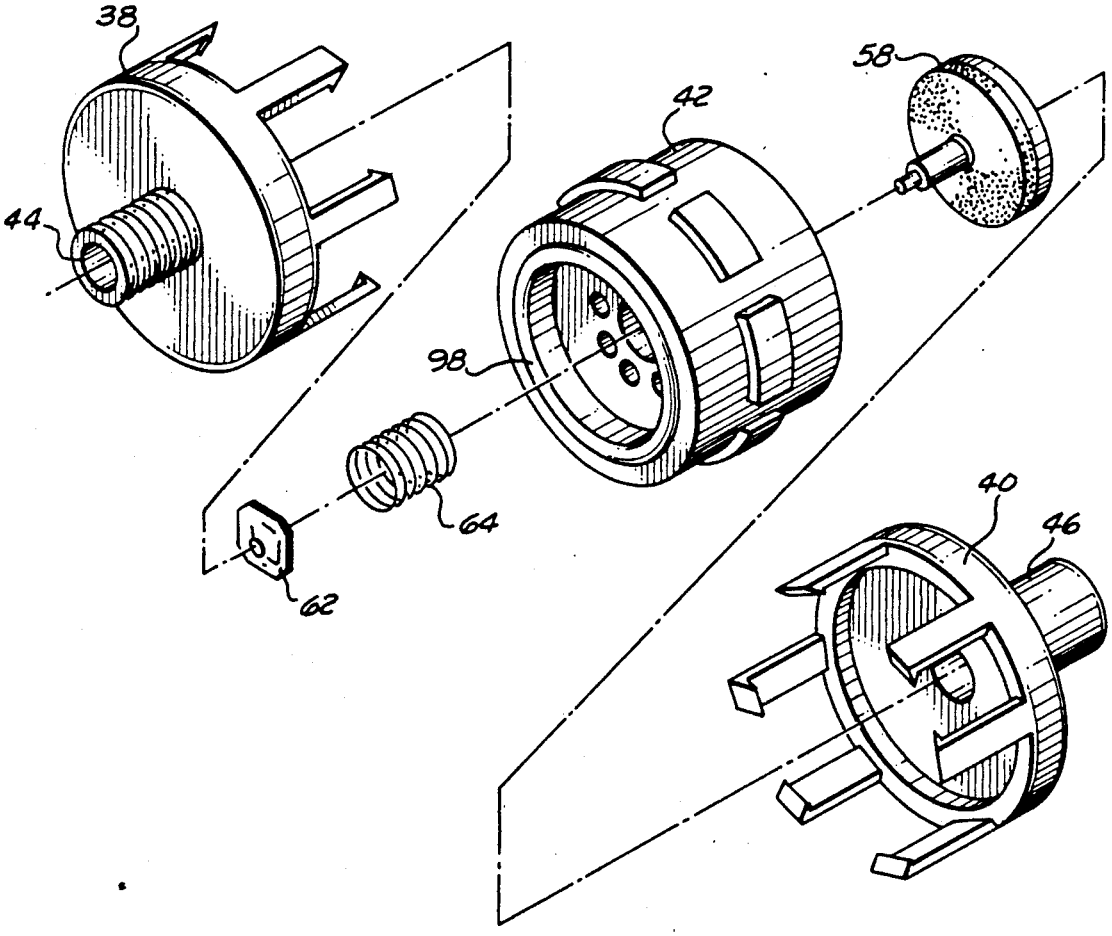

FIG. 8 discloses yet another embodiment of the one-way check valves depicted in FIGS. 1-3. End sections 38 and 40 each include six clips coupled at equal intervals around the periphery of each end section. Center section 42 includes a raised ring having a plurality of six notches. The width of each notch is slightly in excess of the width of the clips extending from end sections 38 and 40. An "O"-ring sealing device 98 is positioned within a notched cutout on each side of center section 42 to provide an hermetic seal between end sections 38 and 40 and center section 42.

The clips of a single end section are slipped through the notches in center section 42 and a compressive force is applied between the end section and the center section such that the end section can be rotated to engage the clips on the raised section of center section 42. The second end section is then coupled to center section 42 by using a similar procedure. The unit is disassembled by using a procedure opposite to that described above.

Figure 9:
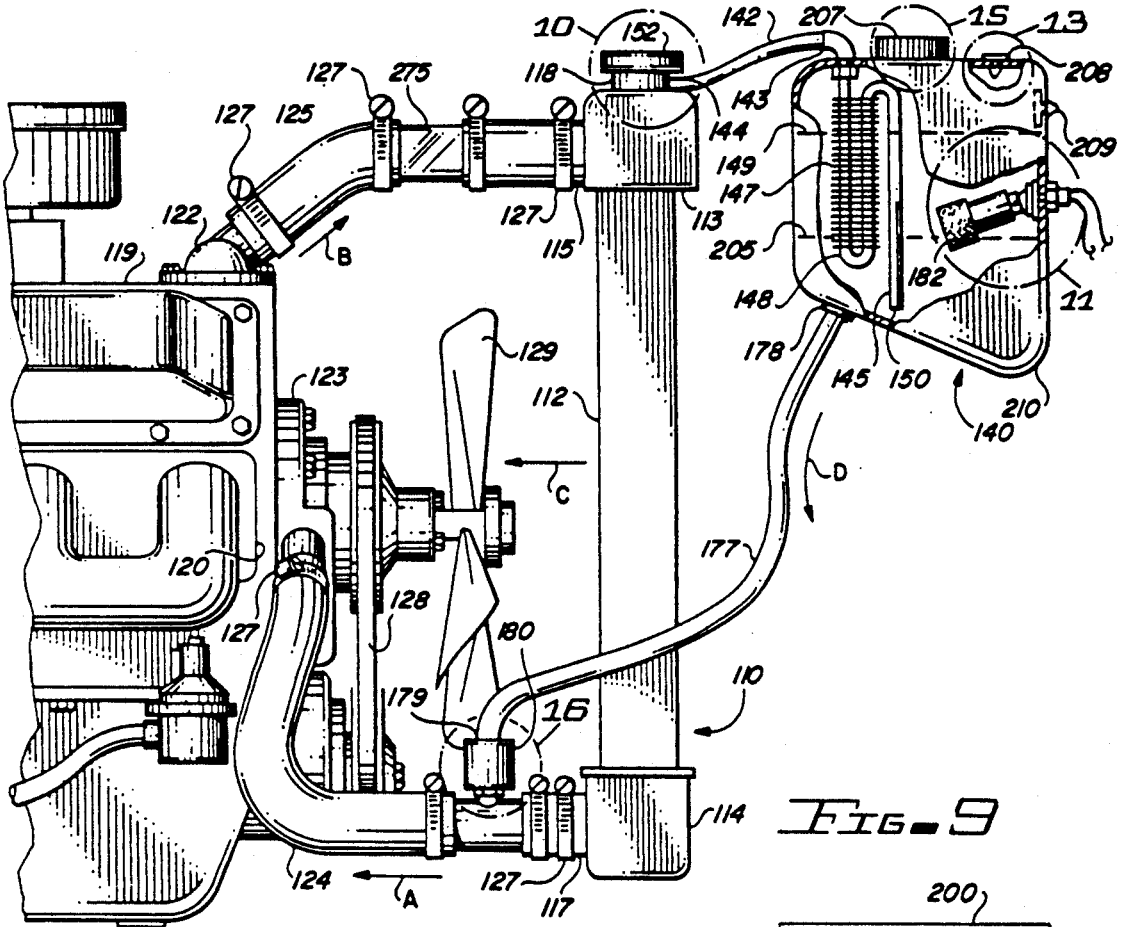
FIG. 9 is a side elevational view of an alternate embodiment of the instant invention, portions thereof being broken away for purposes of illustration.

Turning now to FIG. 9, there is seen an alternate embodiment of the instant invention as it would appear when installed in combination with a preexisting conventional pressurized liquid cooling system as previously described herein. For purposes of additional reference and orientation in connection with the immediate embodiment of the invention, it is seen that the cooling system includes a radiator, generally designated by reference character 110, having a core 112 disposed between an inlet tank 113 and an outlet tank 114. An inlet 115 is carried by inlet tank 113. An outlet 117 is carried by outlet tank 114. In accordance with conventional practice, inlet 115 and outlet 117 are in the form of tubular projections extending from the respective tanks. A filler neck 118 additionally projects from inlet tank 113.

In the immediate illustration, radiator 110 is shown in the conventional position, residing at a spaced location forwardly of engine 119. Although not specifically illustrated but as will be appreciated by those skilled in the art, the conventional cooling system includes a water jacket within engine 119. The water jacket, a circuitous passage embracing each of the several cylinders in which heat is produced as a result of the combustion of fuel, terminates with an inlet 120 and an outlet 122. Inlet 120 generally comprises a portion of water pump 123 which is fitted to the forward end of engine 119 and communicates with the inlet of the water jacket within the engine block. Outlet 122 is generally in the form of a fitting which is secured to engine 119. Inlet 120 and outlet 122 are tubular members corresponding in size to outlet 117 and inlet 115, respectively.

A supply conduit 124 communicates between outlet tank 114 and the inlet 120 of the water jacket. A return conduit 125 communicates between the outlet of the water jacket and the inlet tank 113. In practical application, the conduits are lengths of flexible hose having ends which receive the respective tubular elements and sealingly secured thereto as by hose clamps 127.

Water pump 123, which is caused to rotate in response to rotation of engine 119 through drive belt 128, circulates coolant through the supply conduit 124 in the direction of arrowed line A from the radiator to the water jacket. After having passed through the water jacket and absorbed heat within engine 119, the coolant flows through return conduit 125 in the direction of arrowed line B from the water jacket to the radiator. Within the radiator, the coolant passes from inlet tank 113 through core 112 into outlet tank 114. Core 112 functions as a heat exchanger for lowering the temperature of the heated coolant. To augment the cooling function of core 112, a fan 129, usually affixed to the impeller shaft of water pump 123, draws a stream of air through core 112 along a path indicated by the arrowed line C.

Figure 10:
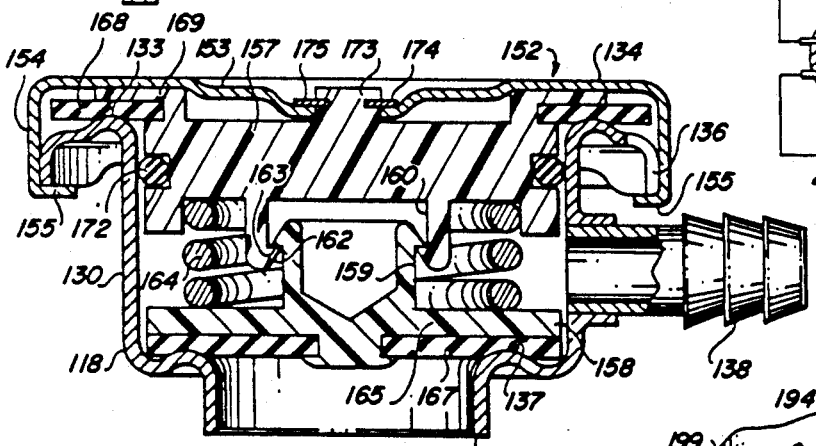
FIG. 10 is an enlarged vertical sectional view taken from the area designated 10 in FIG. 9 and particularly illustrating an inventive closure and valving apparatus of the instant embodiment, the section being taken along the longitudinal axis of the components.

Conventional filler neck 118, which is better viewed in FIG. 10, includes generally tubular member 130 extending between a fixed end 132 which is secured, usually as by welding, to inlet tank 113 and a free open end 133. Open end 133 is shaped outwardly and downwardly to form annular ledge 134 and depending circumferential skirt 136. At a location spaced from open end 133, usually proximate fixed end 132, tubular member 130 is formed generally inwardly and downwardly to provide a pressure valve seat 137, overflow vent 138, a radially projecting tubular element, resides intermediate open end 133 and valve seat 137.

The above described cooling system is intended to be typical of conventional prior art systems. Further and more specific details of the structure and function is considered to be well-known by those skilled in the art. For example, a closure and valving apparatus (radiator cap) of known design is detachably securable with filler neck 118. Further, the radiator cap, as a result of relative rotation with the filler neck, is movable between a removal position, an unlock position, and a lock position as a result of locations defined by engagement receiving means carried by the depending circumferential skirt 1136. For a more thorough understanding of prior art pressurized liquid cooling systems and of closure and valving apparatus, reference is made to U.S. Pat. Nos. 4,079,855 and 4,498,599.

Provided by the instant invention is an accumulator, generally designated by the reference character 140, which may be mounted at any convenient location within the vehicle carrying engine 119. While size is discretionary, it is recommended that accumulator 140 have a capacity sufficient to receive normal engine overflow as a result of thermal expansion and additional capacity to contain a reserve supply of coolant. Overflow conduit 142 communicates between accumulator 140 and a high point in the cooling system. In accordance with the immediately preferred embodiment, overflow conduit 142 includes an outlet end 143 at accumulator 140 and an inlet end 144 affixed to overflow vent 138. A heat exchanger 145, including circuitously routed tubing 148 and ambiently exposed surface area increasing fins 148, is placed in series with and forms an extension of overflow conduit 142. To take advantage of the cooling effect of the coolant within accumulator 140, heat exchanger 145 is carried within accumulator 140 and substantially submerged between the normal coolant supply level indicated by the broken line 149. Discharge end 150 of heat exchanger 145, being in effect the outlet end of conduit 142, resides at a location near the bottom of accumulator 140.

The flow of overflow fluid, air, gaseous vapors, and coolant as result of thermal expansion, from the cooling system through overflow conduit 142 into accumulator 140 is under control of normally closed pressure valve means placed in series with the overflow conduit 142. In accordance with the immediately preferred embodiment of the invention, the pressure valve means is in the form of an especially devised closure and valving apparatus 152 which is secured to filler neck 118 in lieu of the conventional closure and valving apparatus. Valving and closure apparatus 152, a preferred embodiment chosen for purposes of representative illustration and shown in detail in FIG. 10, includes an attachment member 153, normally extending over the open end 133 of filler neck 118, terminating with depending and encircling skirt 154 carrying a pair of opposed inwardly directed tabs 155 which function as engagement means for cooperation with the previously described engagement receiving means of filler neck 118.

Upper seal support member 157 and lower seal support member 158 are carried on the underside of attachment member 153. Lower seal support member 158 is reciprocally movable in directions to and fro relative upper seal support member 157 as a result of the telescoping coupling between projecting tubular members 159 and 160, respectively. After being engaged by snap action, accidental separation of the upper and lower members is prohibited as the result of the interference between outwardly directed annular shoulder 162 carried by projection 159 and inwardly directed annular shoulder 163 carried by projection 160. The compression spring 164, coiled about tubular projections 159 and 160, normally urges lower member 158 in a direction away from upper member 157. The displacement of lower member 158 from upper member 157 is limited by the interference of shoulders 162 and 163.

Disk-like member 165, a portion of lower seal supporting member 158, functions as a backing plate for gasket 167 which is affixed to the underside thereof. Gasket 168 carried by upper seal support member 157 is reinforced by annular flange 169. Toroidal, seal 170 is carried by upper member 157 in groove 172. For purposes of identification, gasket 167 functions as the pressure seal, gasket 168 functions as the upper atmospheric seal and toroidal seal 170 is considered the intermediate atmospheric seal. Upper seal support member 157 is relatively movably affixed to attachment member 153 by virtue of post 173 projecting from upper member 157 through opening 174 in attachment 153 and having lock ring 175 affixed thereto.

With attachment member 153 rotated to the lock position, previously described, pressure seal 167 is urged into sealing engagement with valve seat 137 at the urging of spring 164. Spring 164 is chosen to exert a predetermined pressure whereby seal 167 is lifted from seat 137 for overflow of fluid at the design pressure of the system. During overflow, discharge of fluid to the atmosphere is prevented by first and second atmospheric seals 168 and 170, respectively. It is noted that in the lock position, pressure is exerted by attachment member 153 to sealingly engage gasket 168 with seat 134. The atmospheric seals also prevent the entrance of air when the system exhibits a negative pressure or partial vacuum.

In the unlock position, gasket 167 is lifted from seat 137 to allow the free escape of air, or other fluid, as the system is initially filled with coolant as will be described in further detail presently. In the unlock position, toroidal seal 170 maintains sealing engagement with filler neck 118 whereby communication of the system with the ambient environment is prohibited. Accordingly, it is seen that the valving and closure apparatus functions as a pressure valve, primarily as the result of the interaction of gasket 167 and spring 164 in the lock position, and as a manually operable vent valve when rotated to the unlock position.

Make-up conduit 177 communicates between accumulator 140 and a low point in the system. In accordance with immediately preferred embodiment, make-up conduit 177 includes an inlet end 178 affixed to a low point in accumulator 140 and an outlet end 179 secured to supply conduit 124. One-way check valve 180 is located in series with make-up conduit 177. In accordance with the immediately preferred embodiment of the instant invention, check valve 180 receives the outlet end 179 of make-up conduit 177 and is inserted into supply conduit 124 at a location upstream of pump 123. Further description of check valve 180 will be made presently.

Figure 11:
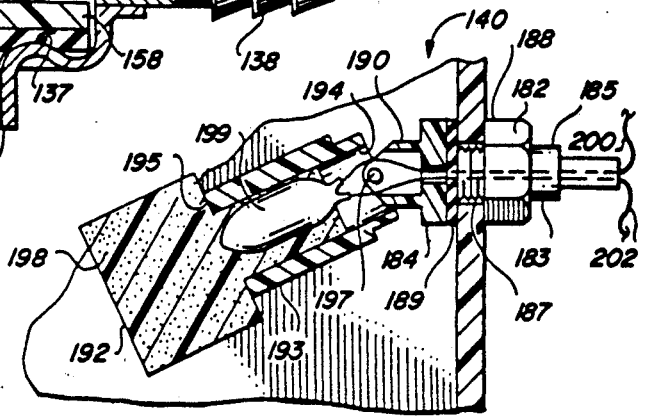
FIG. 11 is an enlarged elevational view partly in section and further detailing the sensor means seen within the area designated 11 in FIG. 9.

Further included in the instant invention are signaling means for providing a sensible indication that the coolant within the accumulator has descended a predetermined level. The signaling means includes a sensor carried by the accumulator for emitting a signal when the coolant has descended a predetermined level and indicator means for displaying an indication in response to receiving the signal from the sensor means. An immediately preferred sensor means, generally designated by reference character 182, is seen in FIG. 9. With further reference to FIG. 11, it is seen that sensor means 182 includes attachment bracket 183 having flange 184 residing within accumulator 140 with threaded shank 185 projecting therefrom through opening 187 in accumulator 140. Nut 188 is threadedly engagable with shank 185 on the external side of accumulator 140. Sealing gasket 189 is compressed between flange 184 and accumulator 140 to provide an atmospheric seal. Attachment element 190 projects inwardly from flange 184.

Float switch 192, residing within accumulator 140 is carried by attachment bracket 183. Float switch 192 includes tubular element 193 having a first end 194 and a second end 195. It is noted that tubular element 193 is of sufficient site to loosely encircle attachment element 190. Pin 197, extending diametrically through tubular element 193 proximate first end 194 and through attachment member 190, pivotally affixes float switch 192 to attachment bracket 183. Float 198, fabricated of a boyant material such as a foamed or cellular plastic, is carried by tubular element 193. A switch 199 is embedded within float 198. The leads 200 and 202 from switch 199 project through attachment bracket 183 and are sealingly engaged therewith in accordance with conventional techniques to preserve the integrity of the atmospheric seal with sensor means 182 and accumulator 140.

Figure 12:
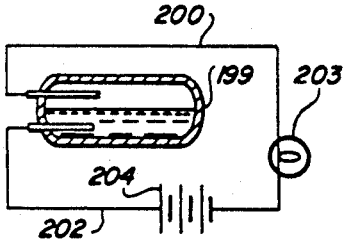
FIG. 12 is a schematic of a signaling means incorporated into the instant invention and including the sensor shown in FIG. 11.

Switch 199 may be of any conventional tilt sensing type. Especially preferred is the device commonly referred to as a "mercury switch". The switch is normally open and is closed in response to being tilted downwardly in the position illustrated. Switch 199, as further seen in FIG. 12, is placed in series with a lamp 203 and a source of electrical energy 204. Lamp 203 may be placed at any desired location, such as in the dashboard of a motor vehicle. Energy source 204 may be the battery of the motor vehicle.

Referring again to FIG. 1, there is seen a broken line, designated by the reference character 205, which represents the low or minimum desirable coolant level. Coolant within accumulator 140 above the level indicated by the line 205 holds float 198 at a sufficiently elevated location to maintain switch 199 in the open position. As the coolant descends the level indicated by the line 205, float 198 drops sufficiently for switch 199 to close. Upon closing of switch 199, a signal, in the form of electrical energy, is passed through leads 200 and 202 thereby illuminating lamp 203 which functions as an indicator means for the motorist. It is noted that level 205 is established at a height in which sufficient coolant remains to provide the motorist with an early warning to react prior to an imminent emergency.

To retard evaporation, expedite condensation of gaseous vapor, and provide other functions as will be appreciated by those skilled the art, accumulator 140 is normally sealed. For this purpose, as seen in FIG. 9, accumulator 140 is provided with normally sealed filler means 207 and relief valves 208 and 209. It is noted that accumulator 140 includes a container 210 in the form of a substantially continuous shell. The fabrication of such devices by various techniques, including plastic molding technology, will be readily appreciated by those skilled in the art. The respective ends of overflow conduit 142 and make-up conduit 177 are affixed to the shell by conventional couplings sealingly engaged therewith.

Figure 13:
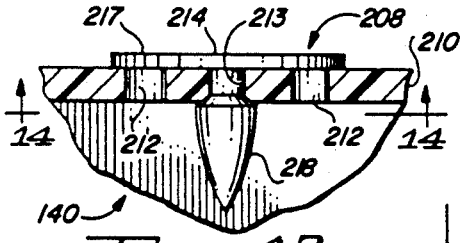
FIG. 13 is an enlargement of the area designated 13 in FIG. 9, the illustration being partly in the section.
Figure 14:
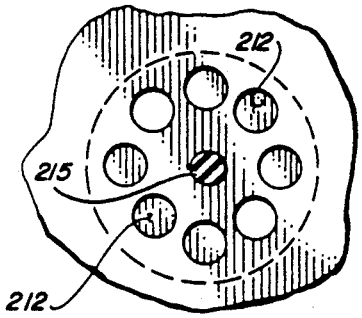
FIG. 14 is a horizontal sectional view taken along the line 14—14 of FIG. 13.

Relief valve 208, as seen in greater detail with reference to FIGS. 13 and 14, includes a plurality of apertures 212 extending through container 210 in a spaced pattern circumscribing generally centrally located opening 213. Valving member 214 includes stem 215 projecting through opening 213 and carrying, respective ends thereof, disk-like member 217 overlying the several apertures 212 and an enlargement 218 functioning as a retention member. The length of stem 215 is such that container 210 is held in compression between disk-like member 217 and enlargement 218 to sealingly close opening 213.

Preferably fabricated of a rubber-like material, such as neoprene, disk-like member 217 functions as a flapper valve for normally closing apertures 212. Residing on the external side of container 210, disk-like member 217 further functions as a one-way check valve. In response to pressure within accumulator 140 exceeding a predetermined maximum value, disk-like member 217 is unseated permitting the escape of fluid through the openings 212 to relieve excess pressure within accumulator 140. In accordance with the immediately preferred embodiment of the invention, relief valve 208 opens at approximately one pound per square inch. Within the scope of the invention, the valve may open at lesser or greater pressures, ranging to as much as three pounds per square inch.

For simplicity and economy of manufacture, relief valve 209 includes duplicate components of relief valve 218. Valving member 214, however, is installed in a reverse manner wherein disk-like member 217 resides on the inner side of container 210. Accordingly, relief valve 219 opens in response to pressure within accumulator 140 descending a predetermined minimum value. It is immediately apparent, that relief valves 208 and 209, being normally closed, retard evaporation of the reserve supply of coolant within accumulator 140. Further, the energy required to open relief valve 208 will be responsible for condensation of gaseous vapors trapped within accumulator 140. Residual pressure within accumulator 140 increases the apparent head pressure at the outlet end 179 of make-up conduit 177, the purpose of which will become apparent as the description ensues.

Figure 15:
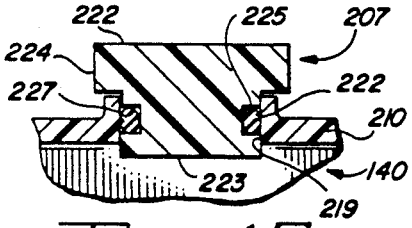
FIG. 15 is an enlarged illustration of the area designated 15 in FIG. 9, the illustration being taken along the longitudinal axis thereof.

Filler means 207, as seen with reference to FIG. 15, includes opening 219 projecting through container 210 the length or internal surface of which is increased by projecting annular neck 220. Closure 222 includes plug portion 223 and enlarged grip portion 224. Plug portion 223, which is sized to be closely received within opening 219, carries external annular groove 225 in which resides circular seal 227.

Filler means 207 cooperates with relief valves 208 and 209 to normally sealingly enclose accumulator 140. Closure 222 is manually removable for replenishment of the coolant supply within accumulator 140 as may be necessary from time to time. The frictional sealing engagement between seal 227 and opening 219, while readily overcome with manual pressure, is greater than the pressure required to open relief valve 208 or relief valve 209.

Figure 16:
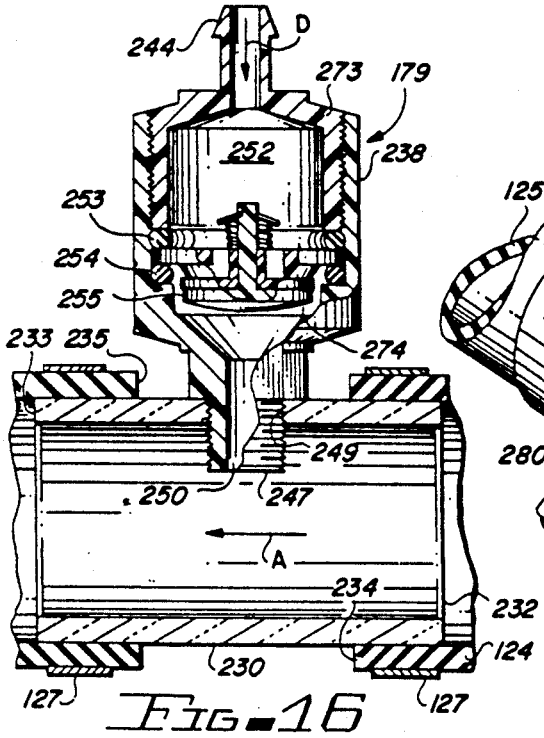
FIG. 16 is an enlarged illustration taken from within the area designated 16 in FIG. 9, the illustration being in vertical sectional view along the longitudinal axis thereof.

A practical and convenient means of connecting the outlet end 179 of make-up conduit 177 to a low point in the cooling system and of inserting check valve 180 in series with make-up conduit 177 is illustrated in FIG. 16. Provided is an insert in the form of an elongate tubular member 230 having an inlet end 232 and an outlet end 233. Supply conduit 124 is severed to provide ends 234 and 235. Tubular member 230, length of standard commercially available ridged pipe of metal or transparent plastic, is chosen to have an external diameter sized to be closely received within conduit 124. Inlet end 232 and outlet end 233 are inserted into respective ends 234 and 235 of the severed conduit 124. A hose clamp 127 is tightened about each pair of coupled ends to provide a seal to withstand maximum system pressures. For purposes of orientation, the normal direction of flow through conduit 124 and tubular member 130 is indicated by the arrowed line A previously noted in FIG. 9.

Figure 17:
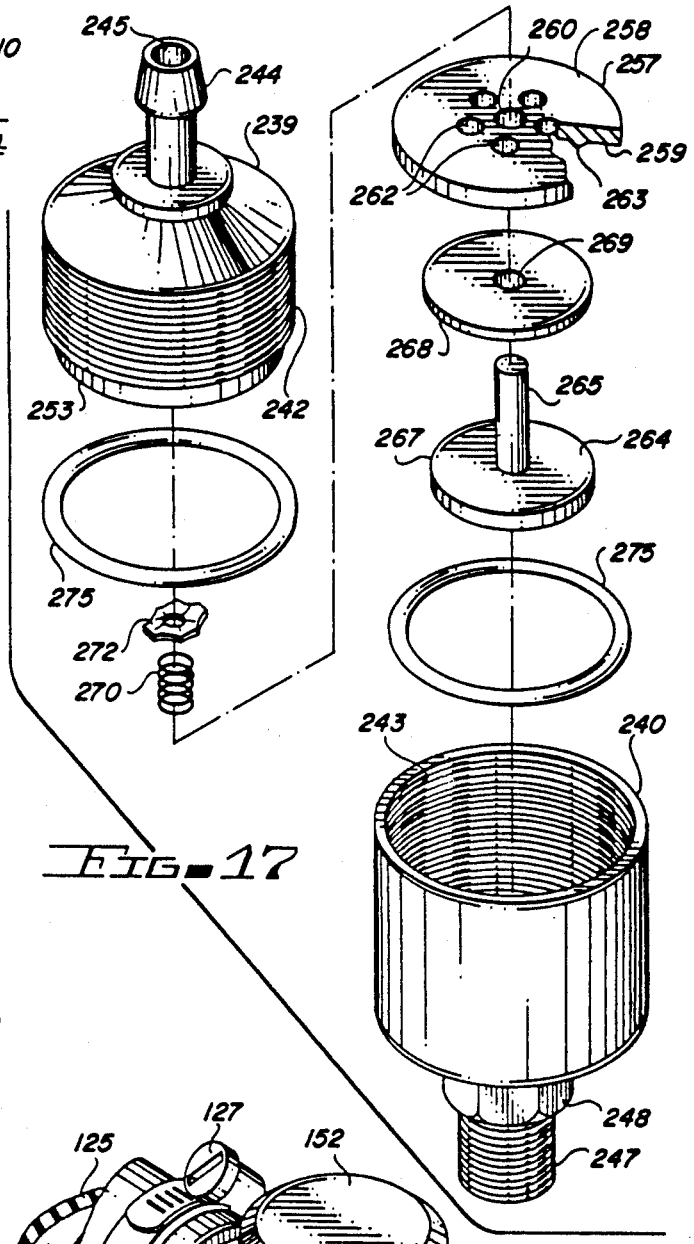
FIG. 17 is an exploded perspective view of the one-way check valve seen in FIG. 16.

Check valve 180, additionally illustrated in FIG. 17, includes hollow body 238 comprising an inlet section 239 and an outlet section 240. Preferably, each section is generally tubular. An external thread 242 carried by inlet section 239 and a matingly engagable internal thread 243 function as element and complemental element of an engagement pair for detachable engagement of the sections to form body 238.

Chamber 252 resides within body 238 intermediate the inlet port and the outlet port. A pair of opposed annular shoulders 253 and 254 reside within chamber 252. Shoulder 253 is the end of inlet section 239 opposite hose coupling 244. Shoulder 254 is an inwardly directed flange formed proximate the termination of internal thread 243 of outlet section 240.

Valving assembly 255 is carried within chamber 252. Valving assembly 255 includes valve plate 257, a generally disk-like member having an inlet side 258 and an outlet side 259. Extending through valve plate 257 is a generally axial bore 260 surrounded by a plurality of apertures 262. Valve seat 263, an annular projection being generally triangular in cross-section and encompassing the several apertures 262, extends from the outlet side 259.

Valving assembly 255 further includes valving member 264 having stem 265, slidably and reciprocally movable within bore 260 and radial flange 267 coaxially carried by stem 265 on the outlet side 259 of valve plate 257. Gasket 268 having bore 269 for receiving stem 265 therethrough, resides intermediate valve plate 257 and valving member 264. Biasing means, preferably in the form of compression spring 270 encircling the portion of stem 265 projecting beyond side 258 of plate 257 and retained by clip 272 affixed to stem 265 proximate the free end thereof, normally urges valving assembly 255 into the closed position in which gasket 268 compressively and sealingly resides between valve seat 263 and flange 267.

Tubular hose fitting 244 projecting from inlet section 242 for receiving the outlet end 179 of make-up conduit 177 in accordance with conventional procedure, and having opening 245 therethrough functions as the inlet port for body 238. Threaded projection 247 having wrench receiving portion 248 is threadedly securable within threaded aperture 249 of tubular member 230 in accordance with conventional procedure extending from outlet section 240 and having opening 250 therethrough projection 247 as the outlet port for body 238.

Shoulders 253 and 254 cooperate as retention means for removably holding valving assembly 255 within body 238. Flange 267 is sized to be received between the shoulders and compressively engaged therebetween as inlet section 239 is tightened within outlet section 240. Valve plate 257 functions to subdivide chamber 252 into an inlet chamber 273 adjacent inlet opening 245 and an outlet chamber 274 adjacent outlet opening 250. A toroidal seal, such as conventional "O"-ring 275, is placed on either side of valve plate 257 to be compressed between the plate and the respective shoulder to seal chamber 273 from chamber 274 except for fluid flow through apertures 262 at such times as the valve is open.

Check valve 180 is considered to be normally closed in view of the biasing of spring 270. Spring 270 is selected to exert relatively light closing pressure upon valving assembly 255. While the closing pressure may be of any desired value, pressures in the range of one pound per square inch are considered generally adequate. In a conventional pressurized cooling system, at rest and thoroughly cooled, the pressure in supply conduit 124 may be one pound per square inch or less. The head pressure at outlet end 179 of make-up conduit 177, as a result of the height of reservoir 140 and the contained residual pressure, may be in the range of two or more pounds. Accordingly, the pressure differential across valve 180 may be nil. As a result, valving assembly 255 is neither definitively held open nor definitively held closed. In essence, coolant within reservoir 140 is in constant communication with fluid within the system.

A primary purpose of spring 270 is to provide direction and impetus for valve 180 to close upon the commencement of buildup of pressure within the cooling system. Experimentation has shown that within a properly functioning thoroughly warmed liquid pressurized cooling system, the lowest system pressure resides immediately upstream of the water pump. In the at rest, cool condition, the pressure in supply conduit 124 immediately upstream of the water pump may be only approximately one-fourth the pressure exhibited in outlet tank 114. Further, the flow of fluid through supply conduit 124 is most responsive to a leak within the coolant system. Accordingly, it is preferred that the outlet end 179 of make-up conduit 177 communicate with the cooling system at a location within supply conduit 124 for prompt replenishment of any coolant lost as a result of a leak.

The immediate invention makes possible the initial filling of the coolant system while concurrently purging substantially all of the air from the system. With closure 222 removed, coolant is introduced into accumulator 140 through opening 219. In response to the head pressure, as fluid flows in a direction of arrowed line D seen in FIGS. 9 and 16, valve 180 opens allowing flow of fluid into the system. As the system fills from the bottom, air is displaced and urged upwardly. To accommodate the escape of air, the system is vented by rotating attachment member 153 to the unlock position. The expelled air, and eventually the tell-tale stream of coolant indicating that the system is full, will pass into accumulator 140. The air will be allowed to escape through opening 219. As a result of manual observation, the filling procedure is stopped when the desired level of reserve coolant remains within accumulator 140.

For visual examination of the character of the coolant within the system, a viewing window is placed at a high point. Such a window is seen with additional reference to FIG. 9. A tubular insert 277 is placed in series with return conduit 125. The insert, preferably transparent section of tube or pipe, is installed into return conduit 125 by severing the conduit 125 and proceeding as described in connection with the installation of tubular member 230. The window is especially useful for ascertaining the presence of entrained air or the generally condition of the coolant while the system is in operation, pressurized and hot, at a time when removal of the normal filler cap would be prohibitive. It is noted that a majority of leaks involve the sealing between the radiator cap and the filler neck.

"As previously noted, the cooling system shown in FIG. 9 for purposes of orientation is intended to be illustrative of typical prior art systems. Chosen for purposes of illustration is a conventional down flow radiator in which the inlet tank and the outlet tank are respectively located above and below the core. The filler neck, to which is secured the closure and valving apparatus, projects upwardly from the inlet tank. Other radiator configurations are well known to those skilled in the art. Exemplary is the cross-flow radiator in which the inlet tank and the outlet tank extend vertically along respective sides of the core. Also known are designs wherein the filler neck is positioned at a lower elevation thereby creating an inherent space in the upper portion of one or both of the tanks in which air can become trapped. The immediate invention is readily adapted for use in connection with such coolant systems. It is also contemplated by the instant invention that the conventional filler neck, regardless of location, can be permanently sealed or closed by a cap not having valving apparatus.

Figure 18:
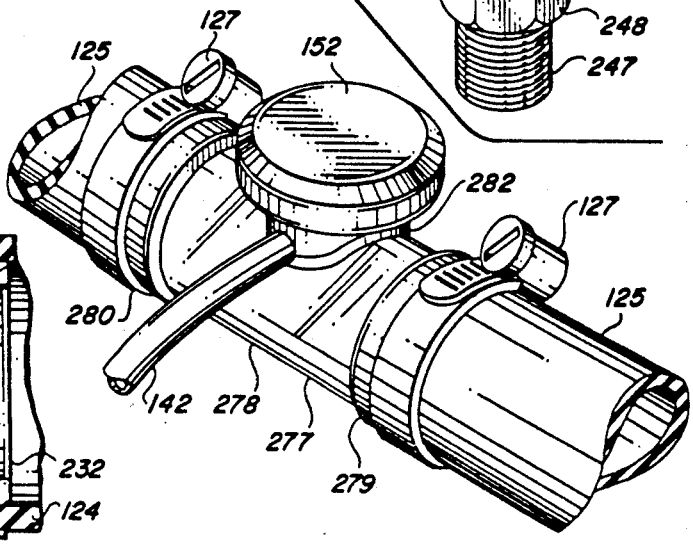
FIG. 18 is a fragmentary perspective view of the return conduit of a conventional pressurized liquid cooling system and having an alternate embodiment of pressure valve means of the instant invention associated therewith.

To accommodate systems of the foregoing type, the instant invention provides a modification to the previously described insert 277. With particular reference to FIG. 18, it is seen that insert 277 includes an elongate tubular member 278 which is inserted into series with conduit 125. To effect the installation, conduit 125 is severed, and if necessary, a section thereof removed, to yield a pair of spaced apart apposed ends 279 and 280. Tubular member 278, which is preferably but not limited to fabrication of a transparent material, is chosen to have an external diameter which corresponds to the internal diameter of conduit 125. In accordance with conventional practice, respective ends of member 278 are inserted into respective ends of the severed conduit 125 and secured by means of conventional hose clamps 127.

A filler neck 282 projects radially from member 278. Filler neck 282, being of conventional configuration, is analogous to the previously described filler neck 118 including the detachable of closure and valving apparatus 152. Filler neck 282 is secured to elongate member 287 by any conventional technique having regard for the material fabrication. Although not specifically illustrated, but as will be appreciated by those skilled in the art, an opening extends through the side wall of elongate member 278 and the interior of filler neck 282. Further, means are provided for the attachment for over flow conduit 142.

FIG. 19 illustrates alternate means for condensing the vaporous mixture expelled from the radiator 110 in response to thermal expansion of the fluid within the coolant system. A heat exchanger, generally designated by the reference character 290, is placed in series with the over-flow conduit 142 to intercept the vaporous mixture between the point of over-flow, herein shown as filler neck 188 and the accumulator 140. As seen in FIG. 20, heat exchanger 290 is of conventional design including air permeable core 290, fluid inlet 293 and fluid outlet 294. The illustration is intended to be representative of the commercially available reduced sized heat exchangers conventionally used as auxiliary devices for cooling engine oil and transmission oil. Such devices are familiar to those skilled in the art.

For optimum functioning, heat exchanger 290 is positioned in an inherent cooling environment. Preferably, heat exchanger 290, is secured to the rear side of the core 112 of radiator 110 within the previously described stream of air indicated by the arrowed line c. The mounting is analogous to the standard technique used in connection with the installation of condensers for air conditioning units for the passage of air therethrough.

Over flow conduit 142 is severed to provide a first section 142*a* extending between filler neck 118 and inlet 293 and a second section 142*b* extending between the outlet 294 and a fitting 295 secured to the top of container 210 of accumulator 140. Tube 297 depends from fitting 295 to an open lower end at a position located below the normal coolant level 298 within accumulator 140. Function of the immediate embodiment of the condensing means is analogous to the previously described condensing means including heat exchanger 145. Cooling in the immediate embodiment, however, is primarily as a result of air instead of liquid. It will be appreciated that the immediate embodiment is usable in combination with the alternate overflow means specifically described in detail in connection with FIG. 18.

Illustrated in FIG. 21 is yet another embodiment of the instant invention utilizing an alternate modification to previously described transparent insert 277. In accordance with the immediate embodiment, a vent valve 300 is installed in insert 277 for purposes of attachment of discharge conduit 302. As better illustrated in FIG. 22, vent valve 300, a conventional pet cock, includes threaded connection 303 and tube fitting 304. In accordance with conventional techniques, the upper side wall of insert 277 is provided with an internal thread, such as by drilling and tapping, to receive threaded connection 303. Three-way connector 307, a conventional tubing T, is installed into over-flow conduit 142. Inlet end 308 of discharge conduit 302 is secured to tube fitting 304. Outlet end 309 of discharge conduit 302 is secured to three-way connector 307.

The immediate embodiment provides selective fluid communication between return conduit 125 and overflow conduit 124. The immediate embodiment is especially useful for venting the cooling system during initial filling as the coolant liquid is added through the filler means 207 of accumulator 140. Vent valve 300 is open during the filling operation and closed thereafter for functioning of the system and improvements as herein previously described. It is especially noted that closure and valving apparatus 150 need not be disturbed during the filling operation thereby preventing any wear or abrasion to the seals and gaskets. Preferably, conduit 302 is elevated above any other component of the system to insure escape of air and substantially complete filling of the system with liquid. Any air remaining will be of relatively minor volume and quickly purged through over-flow conduit 142 during initial engine operation."

Experiments have been conducted to substantiate the validity of the foregoing statements. For example, it can be shown that a pressurized liquid cooling system functioning in combination with the kit of the instant invention will be purged of air more quickly than a pressurized liquid cooling system functioning in combination with a kit of the prior art. Tests have also been conducted which confirm the ability of the immediate invention to compensate for a fluid leak in the system during engine operation. A test of particular significance involves the placement of the accumulator in the trunk of a motor vehicle, a remote and low elevation position with respect to the radiator. Function of the invention was unimpaired.

The foregoing detailed description of the immediate invention has been centered about a remotely located accumulator which receives overflow coolant from a cooling system under certain predetermined conditions. In response to other predetermined conditions, the cooling system receives fluid from the accumulator. The instant invention may also be considered as establishing a path for one-way flow of fluid from a high point in the cooling system to a low point in the cooling system. Flow along the path is subject to certain conditions. Optionally, the fluid flowing along the path may be subjected to certain conditions.

Various modifications and variations to the embodiments herein chosen for purposes of illustration will readily occur to those skilled in the art. To the extent that such modifications and variations do not depart from the spirit of the invention, they are intended to be included therein and limited only by a fair assessment of the following claims:

Having fully described and disclosed the instant invention, and alternate embodiments thereof, in such clear and concise terms as to enable those skilled in the art to understand and practice the same, the invention claimed is:

1. A kit for use in combination with the pressurized liquid cooling system of an internal combustion engine, which system includes a finite fluid capacity, a water jacket having an inlet and an outlet, a radiator having an inlet tank and an outlet tank, a supply conduit having a first end communicating with the outlet tank, and second end communicating with the inlet of the water jacket, a return conduit communicating between the outlet of the water jacket and the inlet tank, and a pump for circulating coolant through the supply conduit from the radiator to the water jacket.

and for purging gaseous matter from the system and for continuous maintenance of the volumetric capacity of coolant with the system, said kit comprising:

a. a valving apparatus positionable in series with said return conduit and including i. pressure valve means being normally closed and being openable in response to pressure within said system exceeding a predetermined value for flow of fluid from said system; and ii. a discharge port for flow of fluid from said valving apparatus when said pressure valve is open;

b. an accumulator having i. an inlet port, ii. an outlet port and valve means communicating with the atmosphere to allow the exchange of air between the atmosphere and the accumulator;

c. an overflow conduit having i. an inlet end securable to the discharge port of said valving apparatus, and ii. an outlet end securable to the inlet port of said accumulator;

d. a make-up conduit having i. an inlet end securable to the outlet port of said accumulator, and ii. an outlet end securable to a low point in said system;

e. a normally closed, one-way check valve for placement in series with said make-up conduit for permitting flow of fluid from said accumulator into said system; and f. coupling means for coupling said outlet end of said make-up conduit to said supply conduit at a location intermediate said first end and said second end.

2. the kit of claim 1, wherein said valving apparatus includes:

a. an elongate tubular body having i. a first end insertable into one of the ends created when said return conduit is severed, and ii. a second end insertable into the other of the ends created when said return conduit is severed; and b. means for sealingly engaging each of said ends created when said return conduit is severed with the respective ends of said tubular body.

3. The kit of claim 2, wherein said valving apparatus further includes:

a filler neck projecting from said tubular body and having an open end, engagement receiving means proximate the open end, and a valve seat spaced from the open end; and said pressure valve means includes an attachment member having engagement means detachably engagable with said engagement receiving means, a valve member sealingly engagable with said valve seat, biasing means normally urging said valve member into sealing engagement with said valve seat, said biasing means being yieldable at said predetermined value for flow of fluid from said system to said discharge port.

4. The kit of claim 3, wherein said discharge port is carried by said filler neck intermediate said open end and said valve seat.

5. The kit of claim 4, wherein said pressure valve means is movable relative said filler neck between:

a lock position in which said valve member is in sealing engagement with said valve seat; and an unlock position in which said valve member is spaced from said valve seat said system being vented through said discharge port when said pressure valve means is in said unlock position.

6. The kit of claim 5, wherein said check valve opens in response to pressure from the head of fluid from said accumulator when said system is vented.

7. The kit of claim 2, further including normally closed vent means carried by said tubular body and determinedly openable for selectively venting said system.

8. The kit of claim 7, wherein said vent means includes:

a. a vent valve having a discharge port and selectively movable between a closed position and an open position; and b. a vent conduit having i. an inlet end securable with the discharge port of said vent valve, and ii. an outlet end communicating with said accumulator.

9. The kit of claim 7, wherein said check valve opens in response to pressure from the head of fluid from said accumulator when said system is vented.

10. The kit of claim 1, wherein said check valve opens for flow of fluid from said accumulator into said system in response to the volume of fluid in said system being less than the capacity of said system.

11. The kit of claim 1, wherein said accumulator includes normally sealed filler means for introduction of coolant into said accumulator.

12. The kit of claim 1, further including heat exchanger means in series with said overflow conduit for cooling said fluid before being received within said accumulator.

13. The kit of claim 12, wherein said heat exchanger resides proximate a terminal portion of said overflow conduit within said accumulator.

14. The kit of claim 12, wherein said cooling system further includes means for moving a stream of air through said radiator and wherein said heat exchanger resides within the path of said stream of air.

15. The kit of claim 1, further including window means positionable within said system for providing a visually perceptible indication of the character of the coolant.

16. The kit of claim 15, wherein said window means is carried by the tubular body of said valving apparatus.

17. The kit of claim 1, further including signaling means for providing a sensible indication that coolant within said accumulator has descended a predetermined level.

18. The kit of claim 17, wherein said signaling means includes:

a. a sensor carried by said accumulator for emitting a signal when the coolant has descended a predetermined level; and b. indicator means for displaying said sensible indication in response to receiving the signal from said sensor means.

19. The kit of claim 1, wherein said system includes a filler neck extending from the inlet tank of said radiator and said kit includes means for sealingly closing said filler neck.

20. The kit of claim 1, wherein said coupling means comprises:

a) an elongate tubular body having one end insertable into one of the two new ends created when said supply conduit is severed, and ii) an opposite end insertable into the other of the two ends created when said supply conduit is severed, and iii) an inlet port intermediate said one end and said opposite end for communicating with the outlet end of said make-up conduit; and b) means for sealingly engaging each of said ends created when said supply conduit is severed with the respective ends of said tubular body.

21. The kit of claim 20, wherein said tubular body is substantially rigid.

22. The kit of claim 20, wherein said one-way check valve is contained within a hollow valve body including a) an inlet section comprising a fitting for receiving said outlet end of said make-up conduit; and b) an outlet section comprising engagement means for cooperating with complemental engagement means surrounding said inlet port to detachably couple said valve body to said tubular body.

23. A kit for use in combination with the pressurized liquid cooling system of an internal combustion engine, which system includes a finite fluid capacity, a water jacket having an inlet and an outlet, a radiator having an inlet tank and an outlet tank, a supply conduit communicating between the outlet tank, and the inlet of the water jacket, a return conduit communicating between the outlet of the water jacket and the inlet tank, and a pump for circulating coolant through the supply conduit from the radiator to the water jacket, and for purging gaseous matter from the system and for continuous maintenance of the volumetric capacity of coolant with the system, said kit comprising:

a. a valving apparatus positionable in series with said return conduit and including i. pressure valve means being normally closed and being openable in response to pressure within said system exceeding a predetermined value for flow of fluid from said system; and ii. a discharge port for flow of fluid from said valving apparatus when said pressure valve is open;

b. a normally sealed accumulator having i. an inlet port, ii. an outlet port, and iii. a normally closed second relief valve opening in response to pressure within said accumulator descending below a predetermined value;

c. an overflow conduit having i. an inlet end securable to the discharge port of said valving apparatus, and ii. an outlet end securable to the inlet port of said accumulator;

d. a make-up conduit having i. an inlet end securable to the outlet port of said accumulator, and ii. an outlet end securable to a low point in said system; and e. a normally closed, one-way check valve for placement in series with said make-up conduit for permitting flow of fluid from said accumulator into said system.

24. The kit of claim 23, wherein said accumulator further includes a normally closed front relief valve opening in response to pressure within said accumulator exceeding a predetermined value.

* * * * *

UNITED STATES PATENT AND TRADEMARK OFFICE

CERTIFICATE OF CORRECTION

PATENT NO. : 5,044,430

DATED : September 3, 1991

INVENTOR(S) : Walter C. Avrea

It is certified that error appears in the above-identified patent and that said Letters Patent is hereby corrected as shown below:

Column 3, line 52, delete "imeliorated" and substitute therefor --ameliorated--.

Column 9, line 16, delete "one" and substitute therefor --the--.

Column 9, line 16, after "valve" delete "36".

Column 11, line 46, delete "Delrino" and substitute therefor --Delrin®--.

Column 12, line 16, delete "Fittings" and substitute therefor --fittings--.

Column 14, line 3, after "137" insert --.--.

Column 14, line 3, delete "overflow" and substitute therefor --Overflow--.

Column 14, line 17, delete "1136" and substitute therefor --136--.

Column 15, line 17, after "Toroidal" delete ",".

Column 16, line 21, delete "site" and substitute therefor --size--.

Column 16, line 44, delete "FIG. 1" and substitute therefor --FIG. 9--.

Column 20, line 8, before "As" delete """.

Column 21, line 60, after "operation." delete """.

UNITED STATES PATENT AND TRADEMARK OFFICE

CERTIFICATE OF CORRECTION

PATENT NO. : 5,044,430

DATED : September 3, 1991

INVENTOR(S) : Walter C. Avrea

It is certified that error appears in the above-identified patent and that said Letters Patent is hereby corrected as shown below:

Column 22, line 57, after "port," insert —and—.

Signed and Sealed this

Twenty-third Day of November, 1993

Bruce Lehman

*Attest:*

BRUCE LEHMAN

*Attesting Officer*

*Commissioner of Patents and Trademarks*